United States Patent [19]

Martin

[11] 4,186,646

[45] Feb. 5, 1980

[54] ADJUSTABLE CHARGING BAR

[76] Inventor: Carl D. Martin, 18824 Grade School Rd., Caledonia, Ill. 61011

[21] Appl. No.: 877,256

[22] Filed: Feb. 13, 1978

Related U.S. Application Data

[63] Continuation of Ser. No. 389,121, Aug. 17, 1973, abandoned.

[51] Int. Cl.[2] ..... F42B 33/02

[52] U.S. Cl. ..... 86/29; 86/28

[58] Field of Search ..... 86/23–36

[56] References Cited

U.S. PATENT DOCUMENTS

| | | | |
|---|---|---|---|
| 629,120 | 7/1899 | Barlow | 86/29 |
| 713,032 | 11/1902 | Wetzig et al. | 86/29 |
| 2,122,216 | 6/1938 | Seawell | 222/308 |
| 2,761,588 | 9/1956 | Shields | 86/23 X |
| 3,009,387 | 11/1961 | Puth | 86/29 |
| 3,135,434 | 6/1964 | Mittelsteadt | 86/31 |
| 3,323,405 | 6/1967 | Thorp | 86/23 |

OTHER PUBLICATIONS 222 307;308

*Primary Examiner*—Harold J. Tudor

*Attorney, Agent, or Firm*—Vogel, Dithmar, Stotland, Stratman & Levy

[57] ABSTRACT

A charging bar for loading or reloading small arm type shells or cartridges. The charging bar comprises adjustment means for incrementally varying the volume of a powder or shot measuring chamber of the charging bar. Such adjustment means may include a rotational means which causes the volume of the measuring chamber to increase when rotated in one direction and the volume to decrease when rotated in the opposite direction.

4 Claims, 6 Drawing Figures

ADJUSTABLE CHARGING BAR

This is a continuation of application Ser. No. 389,121, filed Aug. 17, 1973, now abandoned.

BACKGROUND OF THE INVENTION

This invention relates generally to a device for measuring particle or powder substances used in loading or reloading small arm type shells or cartridges, and more particularly, relates to a charging bar including precise means for measuring powder and/or shot used in the loading or reloading of such cartridges. The invention is still more particularly directed to a charging bar including means for incrementally varying the volumetric measuring capacities of the charging bar.

It is a common practice to use a charge measuring unit to measure the amount of charge delivered to a shell or cartridge. These measuring units are commonly referred to as "charging bars". Generally, a charging bar includes a pair of bores having different volumetric capacities. Usually the charging bar is movably mounted to a holder, so that one bore may be shifted into registry with the delivery end of a storage receptacle of powder, to fill up with the powder; and thereafter, shifted into registry with a hopper to discharge the powder therein for subsequent deposit into a cartridge. When the powder is being discharged, the other bore may be in registry with the delivery end of a storage receptacle of shot to fill up with a measured amount of the shot, and thereafter also to be shifted into registry with the hopper for discharge and deposit into the cartridge.

A primary problem with the charging bars previously used was their limitation to accommodate the wide range of charge desired by the marksman or hunter. To overcome this, it was required to own numerous interchangeable charging bars, each having a different incremental charge range. However, due to the large number of charging bars required and the frequency of interchange, this solution was extremely inconvenient and cumbersome.

A means proposed as an improvement over the interchangeable bars, was to provide a plurality of annular disks, for positioning singly or in a stacked relationship inside one or both of the measuring bores. Each such disk was dimensioned to vary the measuring capacity of the bore by an incremental amount. Although the use of the disks facilitated adjustment and reduced costs since only one charging bar was required, substantial inconvenience still existed. The subject invention on the other hand, provides a single charging bar having means for precisely and simply setting the volumetric capacities of the measuring bores or chambers.

Accordingly, a primary object of the subject invention is to provide an adjustable charging bar for precisely varying the amount of charge loaded in shells or cartridges used with small arms, such as the shotgun, rifle, pistol and the like.

Another object is to provide a single adjustable charging bar for measuring incremental variations within a wide range of charge.

Another object is to provide a charging bar used in conjunction with conventional shell or cartridge loading machines, and such charging bar includes adjustable means for varying the amount of charge without removal from the loading machine.

Another object is to provide a charging bar having adjustable means to vary the quantity of shot and/or powder used for loading or reloading shells or cartridges. A related object is that one adjustment means varies the amount of powder and a second adjustment means varies the amount of shot.

Still another object is to provide a single charging bar for loading a variety of different sized shells.

BRIEF DESCRIPTION OF THE DRAWINGS

Referring to the drawings in which the same characters of reference are employed to indicate corresponding or similar parts throughout the several Figures of the drawings.

DESCRIPTION OF THE PREFERRED EMBODIMENT

Figure 1:
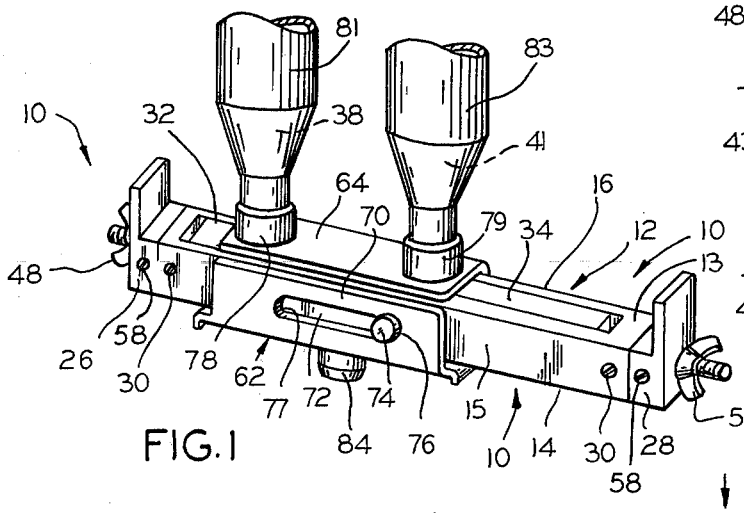
FIG. 1 is a perspective view of the charging bar and holder embodying the principles of the invention.

Referring now to the several Figures of the drawings, the reference numeral 10 indicates generally an adjustable charging bar for loading or reloading shells or cartridges of the small arms type, such as shells for rifles, hand guns, shot guns etc. The charging bar 10 may be used with conventional hand operable shell or cartridge loading devices (not shown).

The charging bar 10 includes a rectangular housing 12 having a top side 13, a bottom side 14, a front side 15 and a back side 16. A centrally positioned partition wall 17 divides the housing into compartments 18 and 20.

Figure 3:
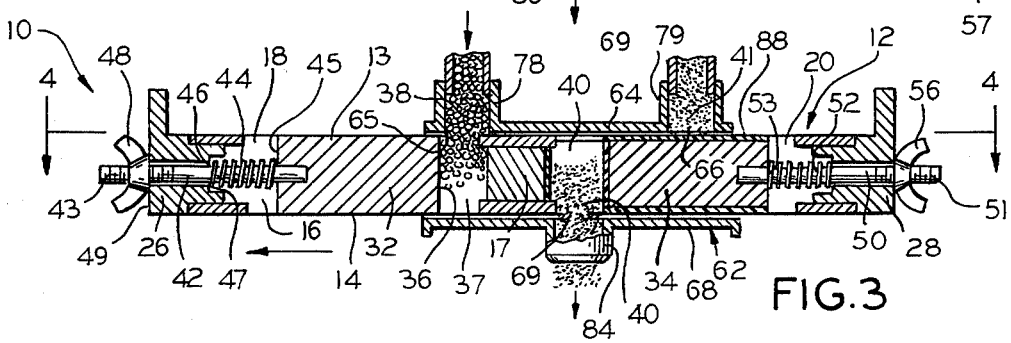
FIG. 3 is a sectional front view similar to FIG. 2 but illustrating the shot chamber being filled while the powder chamber is being discharged.
Figure 4:
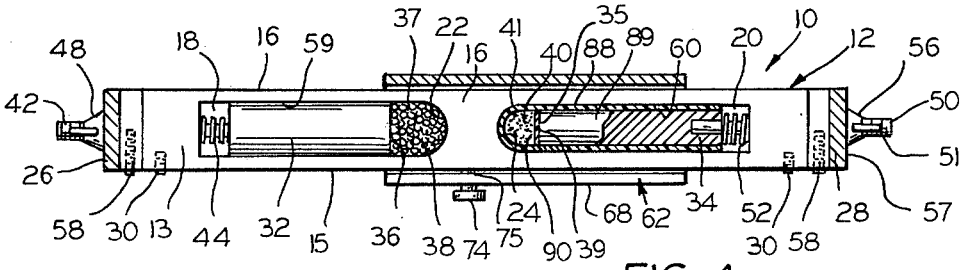
FIG. 4 is a top sectional view of the charging bar and holder in FIG. 1.

The partition wall 17 may be rigidly attached to or an integral part of housing 12. The partition wall 17 (FIGS. 2 and 3) includes a concave outer side 22 (FIG. 4) which is the inner most end of the compartment 18, and an oppositely positioned concave outer side 24 which is the inner most end of the compartment 20.

End walls 26, 28 terminate the opposite ends of housing 12. The end walls 26, 28 are removably secured to the housing 12 by screws 30 or other suitable attaching means.

A piston 32 is positioned in compartment 18 for slidable movement therein. Similarly, a piston 34 is positioned in compartment 20 to also slidably move therein. The space between outer side 22 of the partition wall 17 and the inner end 36 of piston 32 defines a chamber 37 to receive shot 38. The space between outer side 24 of the partition wall 17 and the inner end 39 of piston 34 defines a chamber 40 to receive powder 41.

The volume of shot chamber 37 and the volume of power chamber 40 are set by the positions respectively of pistons 32, 34, which determine the quantity or measure of shot 38 and powder 41 required for filling the corresponding chambers. The pistons 32, 34 are in a fitted relationship in the compartments 18, 20, so that the shot and powder are confined in the corresponding preset chambers 37, 40.

A rod 42 is attached to piston 32 and includes a threaded outer end 43, which passes through end wall 26. An elongated coiled spring 44 encircles rod 42. The inner end 45 of the spring 44 contacts the piston 32 and the outer end 46 thereof contacts the inside grooved surface 47 of end wall 26. The inner and outer ends 45, 46 may be fixidly attached respectively to piston 32 and end wall 26.

Figure 6:
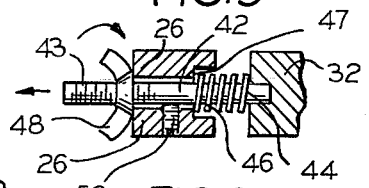
FIG. 6 is a similar fragmentary view of the same end of the charging bar as FIG. 5, to illustrate the adjustment means being utilized to move the piston outward for increasing chamber size.

A wing nut 48 is threadedly associated with the outer end 43 of rod 42. Wing nut 48 is operatively positioned in contact with the outer surface 49 of end wall 26. As the wing nut 48 is rotated, for example in the clockwise direction for inward movement of the wing nut 48 along rod 42 (FIG. 6), wing nut 48 is unable to move inward due to end wall 26; and hence, the rod 42 moves outward through the threads of wing nut 48 and the piston 32 moves responsively toward end wall 26, causing spring 44 to compress. This increases the size of chamber 37.

Figure 5:
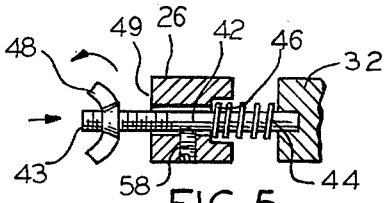
FIG. 5 is a fragmentary view of an end of the charging bar, to illustrate the position of the wing nut just prior to the spring causing the piston to move inward for decreasing the chamber size.

When the wing nut 48 is rotated in the opposite direction to unscrew from the outer end 43 of rod 42, a space occurs between the outer end wall surface 49 and the wing nut 48, as may be seen in FIG. 5. The spring 44 forces the piston 32 inward until the wing nut 48 is again in contact with the outer surface 49 of the end wall 26. This action decreases the size of chamber 37.

Similarly, a rod 50 is attached to piston 34 and includes a threaded outer end 51, which passes through end wall 28. An elongated coiled spring 52 encircles rod 50, and the inner end 53 of the spring contacts the piston 34 and the outer end 54 thereof contacts the inside surface 55 of end wall 28. A wing nut 56 is threadedly associated with the outer end 51 of rod 50. Wing nut 56 is operatively positioned in contact with the outer surface 57 of end wall 28.

When wing nut 56 is rotated in one direction the piston 34 moves outward, as rod 50 threads outward to cause spring 52 to compress and the size of chamber 40 to increase. When wing nut 56 is rotated in the opposite direction away from end wall 28, the piston 34 moves inward under the expanding force of spring 52, to decrease the size of chamber 40.

After the pistons 32 and 34 have been set to their desired positions, locking screws 58 are tightened against the piston shafts to prevent any further movement and variation in the chamber sizes.

Broad longitudinal slots 59 and 60 (FIG. 4) are formed in the top side 13 of the housing 12 and extend respectively across compartments 18 and 20. Although slot 60, compartment 20 and piston 34 are shown smaller in the lateral direction than slot 59, compartment 18 and piston 32, these parts may be dimensioned in any other suitable manner, and may even be of equal dimension.

Charging bar 10 is positioned in a rectangular holder 62 for slidable movement therein. Holder 62 includes a top side 64 having spaced apart circular shot and powder delivery openings 65 and 66 (FIGS. 2 and 3), and a bottom side 68 having a discharge hole 69 positioned midway between delivery openings 65, 66 in the horizontal direction, as viewed in FIGS. 2 and 3.

Figure 2:
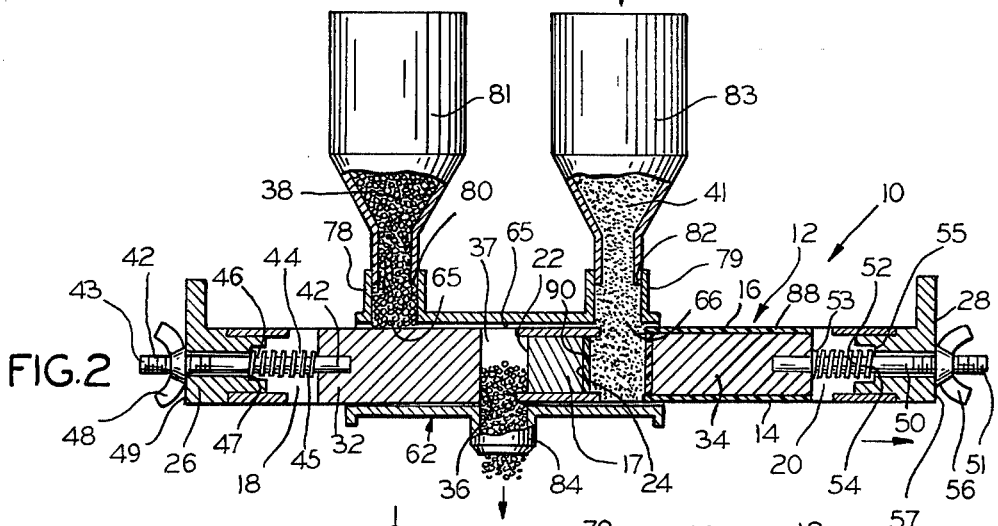
FIG. 2 is a sectional front view of FIG. 1 to illustrate the shot chamber being discharged while the powder chamber is being filled.

The front side 70 of holder 62 includes an elongated notch 72. A knob 74 having a stem 75 which is threadedly or otherwise securely attached to a center point of the front wall 15, extends through notch 72. The charging bar 10 slides to the left when knob 74 is pulled to the left until contacting end 77 (FIGS. 3 and 4), and slides to the right when knob 74 is pulled to the right until contacting end 76 (FIGS. 1 and 2).

Sockets 78, 79 are integrally formed around the openings 65, 66 and extend upward therefrom. The open end 80 of shot receptacle 81, and the open end 82 of a powder receptacle 83 are press fitted into sockets 78, 79.

A dispenser spout 84 may be integrally formed around hole 69, and extends downward therefrom. A hopper may be integrally or rigidly attached so that it encircles spout 84. The measured shot and powder are sequentially discharged from spout 84, and thereafter dispensed into a cartridge.

When knob 74 contacts edge 76, the shot chamber 37 is in registry with the discharge hole 69, and the powder chamber 40 is in registry with the powder delivery opening 66. If the shot chamber 37 had been previously filled, the measured shot 38 contents therein are discharged through hole 69 and spout 84, and simultaneously powder 41 is delivered to chamber 40 via opening 66.

When knob 74 is pulled along notch 72 until contacting edge 77, the shot chamber 37 is in registry with the shot delivery opening 65, and the powder chamber 40 is in registry with discharge hole 69. The powder is now discharged and simultaneously the shot chamber 37 is being filled.

A resilient liner 88 is fitted around the inner surface 89 of compartment 20, to provide a tight fit relationship between the piston 34 and compartment 20, to prevent seepage of the fine grains of powder 41 out of the powder chamber 40, and into the area between piston 34 and slot 60. As a further safeguard against powder leakage, a seal 90 is attached to the innermost surface at the inner end 39 of piston 34. Therefore, the cooperation of liner 88 and seal 90 provides a tight fit relationship, as the piston is selectively moved for setting the size of the powder chamber 40, and thereby retains the powder in the powder chamber.

The charging bar 10 may be used with conventional type loading machines and such conventional machines may include means for supporting shells 11 as they are being loaded. Also, charging bar 10 may be used in combination with other type holders than the holder 62 described herein.

The foregoing specification and description are intended as illustrative of the invention, the scope of which is defined in the following claims.

I claim:

1. A charging bar for loading or reloading shells and cartridges comprising:

a body having at least one elongated compartment therein;

a resilient sealing liner disposed entirely within and lining said compartment and closing one end thereof;

a piston movable in said compartment within said liner, and resilient seal means carried by the inner end of said piston for cooperation with said liner to define a measuring chamber for receiving a substance used in said shells, said liner sealing the space between said piston and said body and cooperating with said seal means to inhibit the passage of the substance therebetween from the measuring chamber.

2. A charging bar for loading or reloading shells and cartridges comprising:

a body having first and second elongated compartments therein;

a resilient sealing liner disposed entirely within and lining said second compartment and closing one end thereof;

a first piston movable in said first compartment for cooperation with said body to define a first measuring chamber for receiving shot;

a second piston movable in said second compartment within said liner, resilient seal means carried by the inner end of said piston for cooperation with said liner to define a second measuring chamber for receiving powder, said liner sealing the space between said second piston and said body and cooperating with said seal means to inhibit the passage of powder therebetween from said second measuring chamber; and first and second adjustment means respectively associated with said first and second pistons to vary the positions thereof for varying the sizes of said first and second measuring chambers.

3. The charging bar set forth in claim 2, wherein the transverse cross-sectional dimensions of said second compartment are smaller than those of said first compartment.

4. The charging bar set forth in claim 2, wherein each of said first and second adjustment means includes means for effecting reciprocating non-rotational movement of the corresponding piston in the corresponding compartment.

* * * * *